US006193817B1

(12) United States Patent
King et al.

(10) Patent No.: US 6,193,817 B1
(45) Date of Patent: Feb. 27, 2001

(54) MAGNESIUM ALLOYS

(75) Inventors: John Frederick King, Bury; Paul Lyon, Bolton; Kevin Nuttall, Bury, all of (GB)

(73) Assignee: Luxfer Group Limited (GB)

( * ) Notice: Subject to any disclaimer, the term of this patent is extended or adjusted under 35 U.S.C. 154(b) by 0 days.

(21) Appl. No.: 08/875,809

(22) PCT Filed: Feb. 6, 1996

(86) PCT No.: PCT/GB96/00261

§ 371 Date: Nov. 17, 1997

§ 102(e) Date: Nov. 17, 1997

(87) PCT Pub. No.: WO96/24701

PCT Pub. Date: Aug. 15, 1996

(30) Foreign Application Priority Data

Feb. 6, 1995 (GB) ..... 9502238

(51) Int. Cl.[7] ..... C22C 23/06

(52) U.S. Cl. ..... 148/420; 148/538; 420/405; 420/406; 420/411; 420/412

(58) Field of Search ..... 148/420, 5.38; 420/405, 406, 411, 412

(56) References Cited

U.S. PATENT DOCUMENTS 5,336,466 * 8/1994 Iba et al. .

FOREIGN PATENT DOCUMENTS

2122148 * 12/1971 (DE) .
4208504 * 9/1993 (DE) .
607588 9/1948 (GB) .
637040 5/1950 (GB) .
664819 * 1/1952 (GB) .
1023128 3/1966 (GB) .
1378281 12/1974 (GB) ..... C22C/23/00
5070880 * 3/1993 (JP) .
5117784 * 5/1993 (JP) .
511785 * 5/1993 (JP) .
6279905 * 10/1994 (JP) .
6316751 * 11/1994 (JP) .
7018364 * 1/1995 (JP) .
20675 * 11/1968 (NO) .
443096 * 8/1975 (SU) .
9412678 * 6/1994 (WO) .

* cited by examiner

*Primary Examiner*—Sikyin Ip
(74) *Attorney, Agent, or Firm*—Conley, Rose & Tayon, P.C.

(57) ABSTRACT

A magnesium base alloy for high pressure die casting (HPDC), providing good creep and corrosion resistance, comprises: at least 91 weight percent magnesium; 0.1 to 2 weight percent of zinc; 2.1 to 5 percent of a rare earth metal component; 0 to 1 weight percent calcium; 0 to 0.1 weight percent of an oxidation inhibiting element other than calcium (e.g., Be); 0 to 0.4 weight percent zirconium, hafnium and/or titanium; 0 to 0.5 weight percent manganese; no more than 0.001 weight percent strontium; no more than 0.05 weight percent silver and no more than 0.1 weight percent aluminum; any remainder being incidental impurities. For making prototypes, gravity (e.g. sand) cast and HPDC components from the alloy have similar mechanical properties, in particular tensile strength. The temperature dependence of the latter, although negative, is much less so than for some other known alloys.

20 Claims, 9 Drawing Sheets

MAGNESIUM ALLOYS

CROSS-REFERENCES TO RELATED APPLICATIONS

This application is filed under 35 U.S.C. § 371 as a national stage application of PCT/GB96/00261 filed Feb. 6, 1996 which claims the benefit of British Pat. App. No. 9502238.0 filed Feb. 6, 1995.

STATEMENT REGARDING FEDERALLY SPONSORED RESEARCH OR DEVELOPMENT

Not applicable

BACKGROUND OF THE INVENTION

1. Field of the Invention

2. Description of the Related Art

This invention relates to magnesium alloys.

High pressure die cast (HPDC) components in magnesium base alloys have been successfully produced for almost 60 years, using both hot and cold chamber machines.

Compared to gravity or sand casting, HPDC is a rapid process suitable for large scale manufacture. The rapidity with which the alloy solidifies in HPDC means that the cast product has different properties relative to the same alloy when gravity cast. In particular, the grain size is normally finer, and this would generally be expected to give rise to an increase in tensile strength with a concomitant decrease in creep resistance.

Any tendency to porosity in the cast product may be alleviated by the use of a "pore free" process (PFHPDC) in which oxygen is injected into the chamber and is gettered by the casting alloy.

The relatively coarse grain size from gravity casting can be reduced by the addition of a grain refining component, for example zirconium in non-aluminium containing alloys, or carbon or carbide in aluminium containing alloys. By contrast, HPDC alloys generally do not need, and do not contain, such component.

Until the mid 1960's it would be fair to say that the only magnesium alloys used commercially for HPDC were based on the Mg—Al—Zn—Mn system, such as the alloys known as AZ91 and variants thereof. However, since the mid 1960's increasing interest has been shown in the use of magnesium base alloys for non-aerospace applications, particularly by the automotive industry, and high purity versions of known alloys, such as AZ91 and AM60, are beginning to be used in this market because of their greatly enhanced corrosion resistance.

However, both of these alloys have limited capability at elevated temperatures, and are unsuitable for applications operating much above 100° C.

Some of the properties considered to be desirable in an HPDC alloy are:

a) Creep strength of the product at 175° C. as good as AZ91 type alloys at 150° C.

b) Room temperature strength of the product similar to AZ91 type alloys.

c) Good vibration damping.

d) Castability of the alloy similar to, or better than AZ91 type alloys.

e) Corrosion resistance of the product similar to AZ91 type alloys.

f) Thermal conductivity of the product preferably better than AZ91 type alloys.

g) Cost equivalent to AZ91 type alloys

One successful alloy development at this stage was within the Mg—Al—Si—Mn system, giving alloys such as those known as AS41, AS21 and AS11; only the first of these has been fully exploited; the other two, although offering even higher creep strengths, are generally regarded as difficult to cast, particularly since high melt temperatures are required. AS41 meets most of the objectives listed above, although its liquidus temperature is about 30° C. higher than that of AZ91 type alloys.

Another series of alloys developed at about the same time included a rare earth component, a typical example being AE42, comprising of the order of 4% aluminium, 2% rare earth(s), about 0.25% manganese, and the balance magnesium with minor components/impurities. This alloy has a yield strength which is similar at room temperature to that of AS41, but which is superior at temperatures greater than about 150° C. (even so, the yield strength still shows a relatively marked decrease in value with rising temperature, as will be mentioned again below). More importantly, the creep strength of AE42 exceeds even AS21 alloy at all temperatures up to at least 200° C.

The present invention relates to magnesium based alloys of the Mg—RE—Zn system (RE=rare earth). Such systems are known. Thus British Patent Specification No. 1 378 281 discloses magnesium based light structural alloys which comprise neodymium, zinc, zirconium and, optionally, copper and manganese. A further necessary component in these alloys is 0.8 to 6 weight percent yttrium. Similarly SU-443096 requires the presence of at least 0.5% yttrium.

British Patent Specification No. 1 023 128 also discloses magnesium base alloys which comprise a rare earth metal and zinc. In these alloys, the zinc to rare earth metal ratio is from ⅓ to 1 where there is less than 0.6 weight percent of rare earth, and in alloys containing 0.6 to 2 weight percent rare earth metal, 0.2 to 0.5 weight percent of zinc is present.

More particularly British Patent Specification Nos 607588 and 637040 relate to systems containing up to 5% and 10% of zinc respectively. In GB 607588, it is stated that "The creep resistance . . . is not adversely affected by the presence of zinc in small or moderate amounts, not exceeding 5 per cent for example . . . ", and "The presence of zinc in amounts of up to 5 per cent has a beneficial effect on the foundry properties for these types of casting where it is desirable to avoid local4sed contraction on solidification and some dispersed unsoundness would be less objectionable". A typical known system is the alloy ZE53, containing a nominal 5 percent zinc and a nominal 3 percent rare earth component.

In these systems it is recognised that the rare earth component gives rise to a precipitate at grain boundaries, and enhances castability and creep resistance, although there may be a slight decrease in tensile strength compared to a similar alloy lacking such component. The high melting point of the precipitate assists in maintaining the properties of the casting at high temperatures.

The two British patents last mentioned above refer to sand casting, and specifically mention the desirability of the presence of zirconium in the casting alloy as a grain refining element. To be effective for such purpose, the necessary amount of zirconium is said to be between 0.1 and 0.9 weight percent (saturation level) (GB 607588) or between 0.4 and 0.9 weight percent (GB 637040).

BRIEF SUMMARY OF THE INVENTION

As used hereinafter, by the term "rare earth" is intended any element or mixture of elements with atomic numbers 57 to 71 (lanthanum to lutetium). While lanthanum is, strictly speaking not a rare earth element, it may or may not be present; however, "rare earth" is not intended to include elements such as yttrium.

The present invention provides a magnesium base alloy for high pressure die casting comprising at least 91.9 weight percent magnesium;

0.1 to 2 weight percent of zinc;

2.1 to 5 weight percent of a rare earth metal component other than yttrium;

0 to 1 weight percent calcium;

0 to 0.1 weight percent of an oxidation inhibiting element other than calcium;

no more than 0.001 weight percent strontium;

no more than 0.05 weight percent silver;

less than 0.1 weight percent aluminium, and substantially no undissolved iron; any balance being incidental impurities.

The invention also provides a magnesium base alloy for high pressure die casting comprising at least 91 weight percent magnesium;

0.1 to 2 weight percent of zinc;

2.1 to 5 weight percent of a rare earth metal component other than yttrium;

0 to 1 weight percent calcium;

0 to 0.1 weight percent of an oxidation inhibiting element other than calcium;

0 to 0.4 weight percent zirconium, hafnium and/or titanium;

0 to 0.5 weight percent manganese;

no more than 0.001 weight percent strontium;

no more than 0.05 weight percent silver; and no more than 0.1 weight percent aluminium.

any balance being incidental impurities.

Oxidation inhibiting elements other than calcium (e.g. beryllium), manganese, and zirconium/hafnium/titanium are optional components and their contribution to the composition will be discussed later.

A preferred range for zinc is 0.1 to 1 weight percent, and more preferably 0.2 to 0.6 weight percent.

Following the ASTM nomenclature system, an alloy containing a nominal X weight percent rare earth and Y weight percent zinc, where X and Y are rounded down to the nearest integer, and where X is greater than Y, would be referred to as an EZXY alloy.

This nomenclature will be used for prior art alloys, but alloys according to the invention as defined above will henceforth be termed MEZ alloys whatever their precise composition.

Compared with ZE53, MEZ alloys can exhibit improved creep and corrosion resistance (given the same thermal treatment), while retaining good casting properties; zinc is present in a relatively small amount, particularly in the preferred alloys, and the zinc to rare earth ratio is no greater than unity (and is significantly less than unity in the preferred alloys) compared with the 5:3 ratio for ZE53.

Furthermore, contrary to normal expectations, it has been found that MEZ alloys exhibit no very marked change in tensile strength on passing from sand or gravity casting to HPDC. In addition the grain structure alters only to a relatively minor extent. Thus MEZ alloys have the advantage that there is a reasonable expectation that the properties of prototypes of articles formed by sand or gravity casting will not be greatly different from those of such articles subsequently mass produced by HPDC.

By comparison, HPDC AE42 alloys show a much finer grain structure, and an approximately threefold increase in tensile strength at room temperature, to become about 40% greater than MEZ alloys. However, the temperature dependence of tensile strength, although negative for both types of alloy, is markedly greater for AE42 alloys than for MEZ alloys, with the result that at above about 150° C. the MEZ alloys tend to have greater tensile strength.

Furthermore, the creep strength of HPDC AE42 alloys is markedly lower than that of HPDC MEZ alloys at all temperatures up to at least 177° C.

Preferably the balance of the alloy composition, if any, is less than 0.15 weight percent.

The rare earth component could be cerium, cerium mischmetal or cerium depleted mischmetal. A preferred lower limit to the range is 2.1 weight percent. A preferred upper limit is 3 weight percent.

An MEZ alloy preferably contains minimal amounts of iron, copper and nickel, to maintain a low corrosion rate. There is preferably less than 0.005 weight percent of iron. Low iron can be achieved by adding zirconium, (for example in the form of Zirmax, which is a 1:2 alloy of zirconium and magnesium) effectively to precipitate the iron from the molten alloy; once cast, an MEZ alloy can comprise a residual amount of up to 0.4 weight percent zirconium, but preferred and most preferred upper limits for this element are 0.2 and 0.1 weight percent respectively. Preferably a residue of at least 0.01 weight percent is present. Zirmax is a registered trademark of Magnesium Elektron Limited.

Particularly where at least some residual zirconium is present, the presence of up to 0.5 weight percent manganese may also be conducive to low iron and reduces corrosion. Thus, as described in greater detail hereinafter, the addition of as much as about 0.8 weight percent of zirconium (but more commonly 0.5 weight per cent) might be required to achieve an iron content of less than 0.003 weight percent; however, the same result can be achieved with about 0.06 weight percent of zirconium if manganese is also present. An alternative agent for removing iron is titanium.

The presence of calcium is optional, but is believed to give improved casting properties. A minor amount of an element such as beryllium may be present, preferably no less than 0.0005 weight percent, and preferably no more than 0.005 weight percent, and often around 0.001 weight percent, to prevent oxidation of the melt. However, if it is found that such element (for example beryllium) is removed by the agent (for example zirconium) which is added to remove the iron, substitution thereof by calcium might in any case be necessary. Thus calcium can act as both antioxidant and to improve casting properties, if necessary.

Preferably there is less than 0.05 weight per cent, and more preferably substantially no aluminium in the alloy. Preferably the alloy contains no more than 0.1 weight percent of each of nickel and copper, and preferably no more than 0.05 weight percent copper and 0.005 weight percent nickel. Preferably there is substantially no strontium in the alloy. Preferably the alloy comprises substantially no silver.

As cast, MEZ alloys exhibit a low corrosion rate, for example of less than 2.50 mm/year (100 mils/year) (ASTM B117 Salt Fog Test). After treatment T5 (24 hours at 250° C.) the corrosion rate is still low.

As cast, an MEZ alloy may have a creep resistance such that the time to reach 0.1 percent creep strain under an applied stress of 46 MPa at 177° C. is greater than 500 hours; after treatment T5 the time may still be greater than 100 hours.

The invention will be further illustrated by reference to the accompanying Figures, and by reference to the appended Tables which will be described as they are encountered. In the Figures:

DETAILED DESCRIPTION OF THE DRAWING

Figure 1:
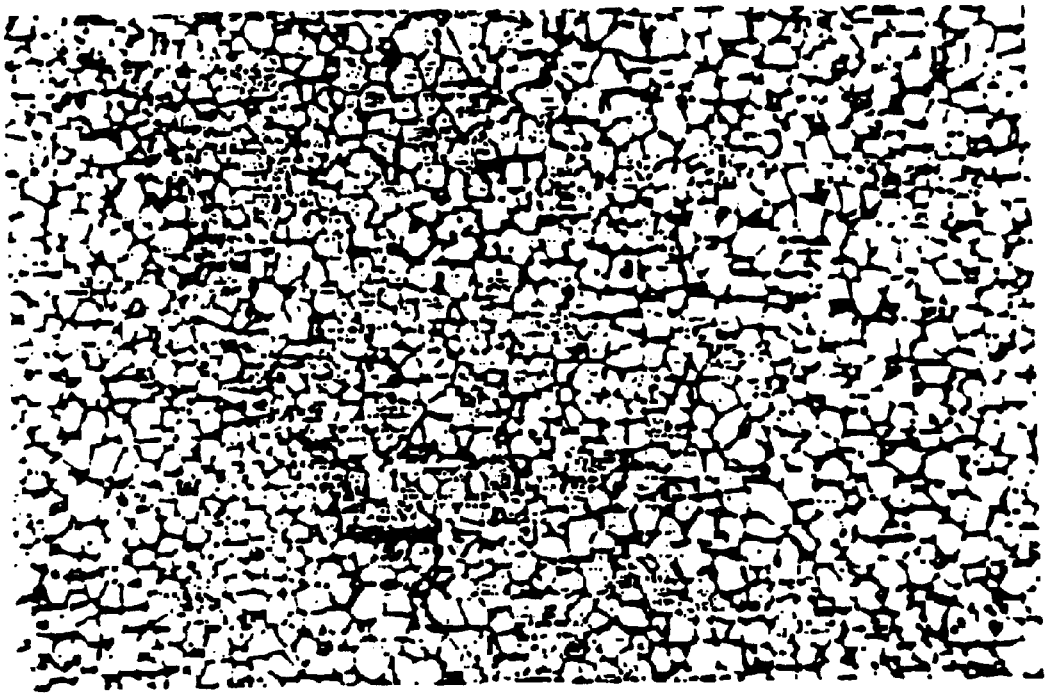
FIG. 1 shows the grain structure of gravity cast ZE53 with high zirconium, melt DF2218.
Figure 2:
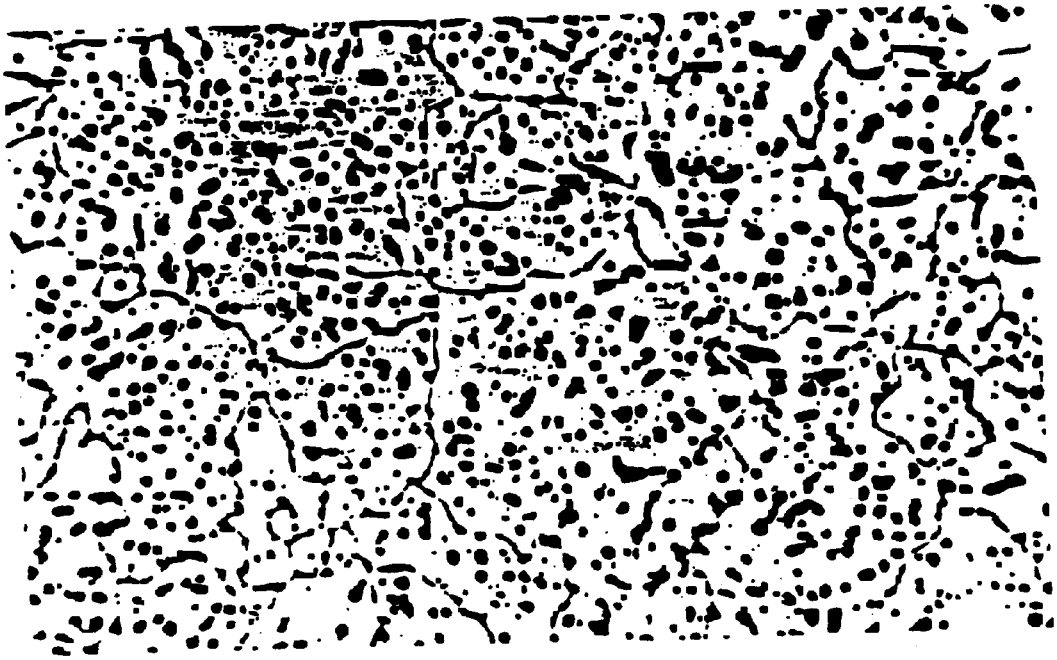
FIG. 2 shows the grain structure of gravity cast ZE53 with manganese added, melt DF2222.
Figure 3:
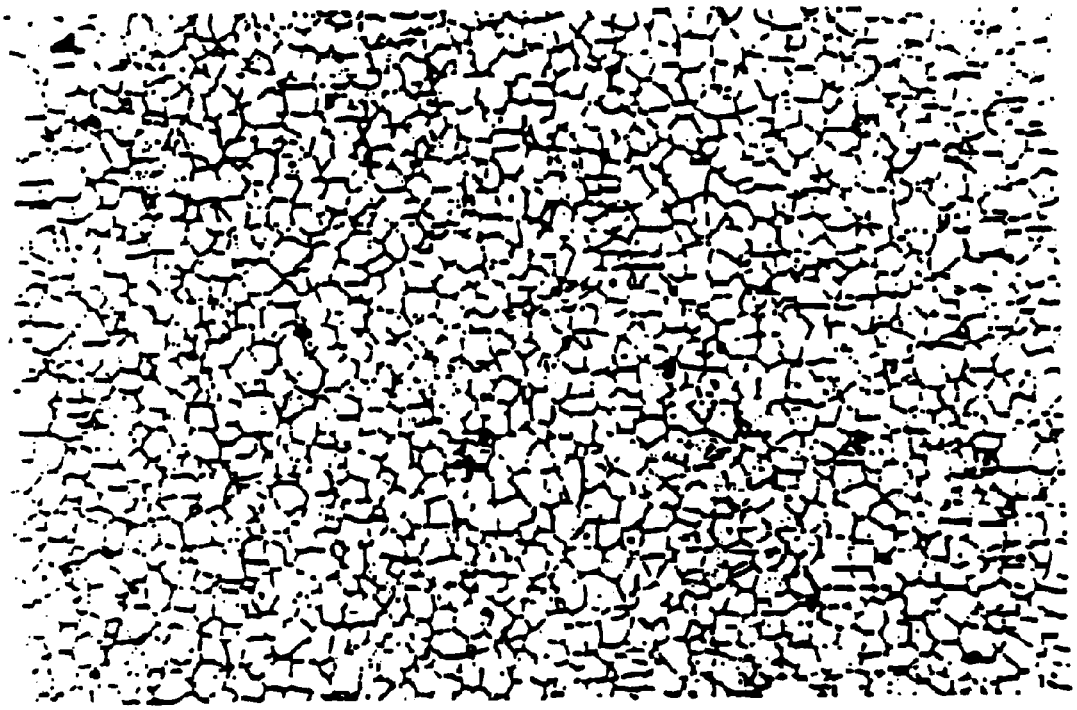
FIG. 3 shows the grain structure of gravity cast MEZ with high zirconium, melt DF2220.
Figure 4:
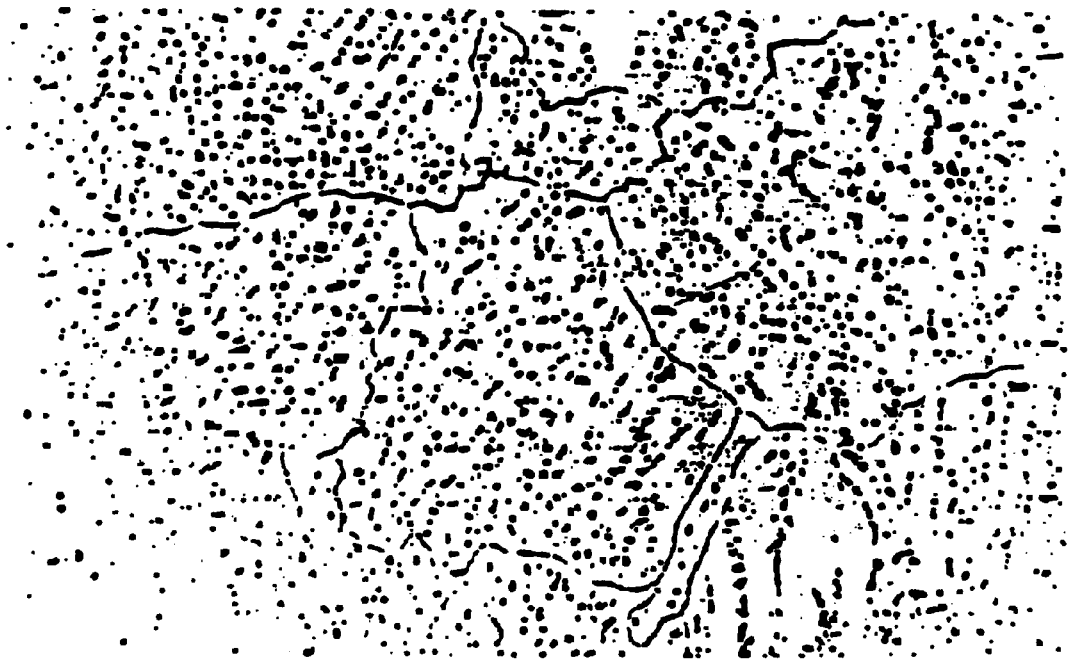
FIG. 4 shows the grain structure of gravity cast MEZ with manganese added, melt DF2224.
Figure 5:
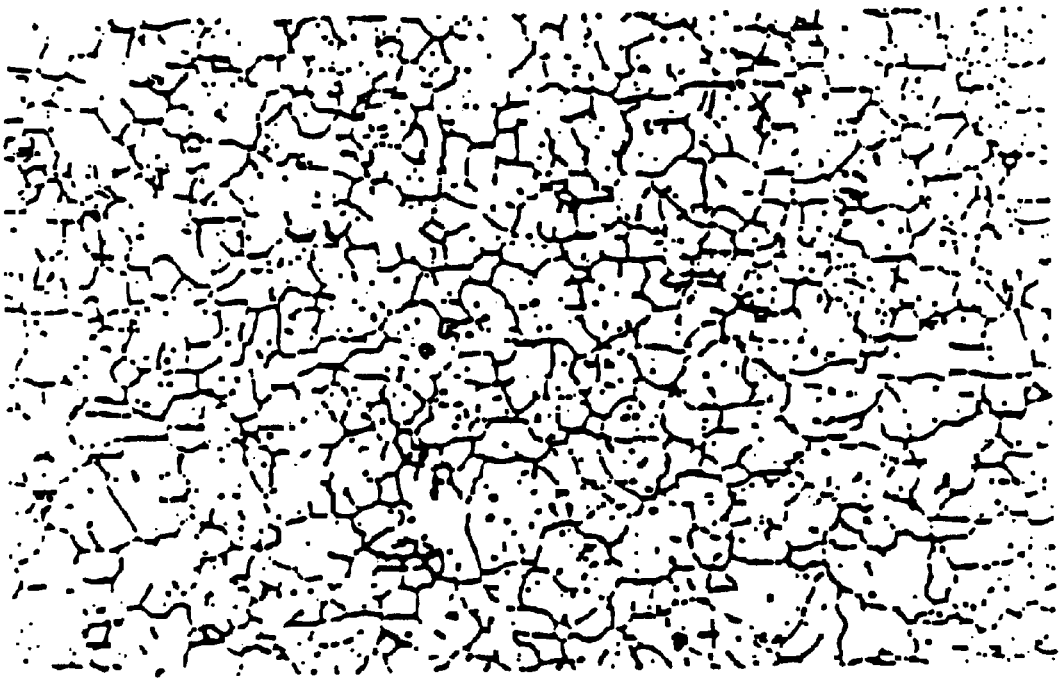
FIG. 5 shows the grain structure of gravity cast MEZ with low zirconium, melt DF2291.

The condition F is "as cast", and T5 treatment involves maintaining the casting at 250° C. for 24 hours. For T6 treatment the casting is held at 420° C. for 2 hours, quenched into hot water, held at 180° C. for 18 hours and cooled in air.

An initial investigation was made into the properties of MEZ alloys and ZE53 alloys in the gravity cast state.

Table 1 relates to ZE53 and MEZ alloys, and indicates the effect of manganese or zirconium addition on the iron, manganese and zirconium content of the resulting alloy.

The first eight of the compositions of Table 1 comprise four variations of each of the alloys MEZ and ZES3. One set of four compositions has manganese added to control the iron content, and the other set has a relatively high zirconium addition (saturation is about 0.9 weight percent) for the same purpose, and arrow bars were gravity cast therefrom. A different set of four selected from these eight compositions is in the as cast state, with the complementary set in the T5 condition.

Table 2 indicates the compositions and states of these eight alloys in more detail, and measurements of the tensile strength of the arrow bars.

Table 3 gives comparative data on creep properties of these eight alloys MEZ and ZE53 in the form of the gravity cast arrow bars.

Table 4 gives comparative data on corrosion properties of the eight alloy compositions in the form of the gravity cast arrow bars, and illustrates the effect of T5 treatment on the corrosion rate.

Corrosion data on another two of the alloys listed in Table 1 is contained in Table 5, measurements being taken on a sequence of arrow bars from each respective single casting. In addition to the elements shown in the Table, each of alloys 2290 and 2291 included 2.5 weight percent rare earth, and 0.5 weight percent zinc. This table is worthy of comment, since it shows that those bars which are first cast are more resistant to corrosion than those which are cast towards the end of the process. While not wishing to be bound to any theory, it seems possible that the iron is precipitated by the zirconium, and that the precipitate tends to settle from the liquid phase, so that early bars are depleted in iron relative to later castings.

FIGS. 1 to 5 show grain structures in some of these gravity cast arrow bars.

From this initial investigation it can be seen that while T5 treatment is beneficial to the creep properties of gravity cast ZES3 alloys, it is detrimental to gravity cast MEZ alloys (Table 3). The creep strengths of ZE53+Zr and both types of MEZ alloy are significantly greater than that of AE42 alloy, and indeed are considered to be outstanding in the case of both MEZ alloys in the as-cast (F) condition and the ZES3 with zirconium alloy in the TS condition. The T5 treatment also benefits the tensile properties of ZES3 with zirconium, but has no significant effect on the other three types of alloy (Table 2).

It will also be seen that iron levels have a significant effect on corrosion rate of all the alloys (Tables 4 and 5). Zinc also has a detrimental effect, and the corrosion resistance of ZE53 was found to be poor even with low iron content. T5 treatment further reduces the corrosion resistance of all alloys. In addition, iron levels remain comparatively high even in the presence of 0.3% Mn (no Zr being present).

When the amount of iron is sufficiently great as to form an insoluble phase in the alloy, corrosion is significant. However, when the amount is sufficiently low for all the iron to remain dissolved within the alloy itself, corrosion is far less of a problem, and accordingly MEZ alloys contain substantially no iron other than that which may be dissolved in the alloy, and preferably substantially no iron at all.

As a result of further testing, it was found that to obtain a suitably low iron level, say 0.003%, an addition of at least 6% Zirmax was necessary in the case of both MEZ and ZE53. However, if manganese is also present, the necessary addition of Zirmax (or equivalent amount of other zirconium provider) is reduced to about 1%.

Casting alloys undergo a certain amount of circulation during the casting process, and may be expected to undergo an increase in iron content by contact with ferrous parts of the casting plant. Iron may also be picked up from recycled scrap. It may therefore be desirable to add sufficient zirconium to the initial alloy to provide a residual zirconium content sufficient to prevent this undesirable increase in iron (up to 0.4 weight percent, preferably no more than 0.2 weight percent, and most preferably no more than 0.1 weight percent). This may be found to be more convenient than a possible alternative course of adding further zirconium prior to recasting.

In one trial, it was found that MEZ material with 0.003% iron resulting from a 0.5% Zirmax addition underwent an increase in iron to 0.006% upon remelting, with the zirconium content falling to 0.05%. However, MEZ material with 0.001% iron resulting from a 1% Zirmax addition underwent an increase in iron only to 0.002% upon remelting, with the zirconium content remaining substantially constant.

To investigate the properties of HPDC alloys, an ingot of MEZ of composition 0.3% Zn, 2.6% RE (rare earth), 0.003% Fe, 0.22% Mn and 0.06% Zr was cast into test bars using both HPDC and PFHPDC methods. The details of the casting methods are appended (Appendix A).

Analysis of the bars is given in Table 6, where FC1, FC2, FC3 respectively represent samples taken at the beginning, middle and end of the casting trial. The high Zr figure of the first listed composition indicates that insoluble zirconium was present, suggesting an error in the sampling technique.

Figure 6:
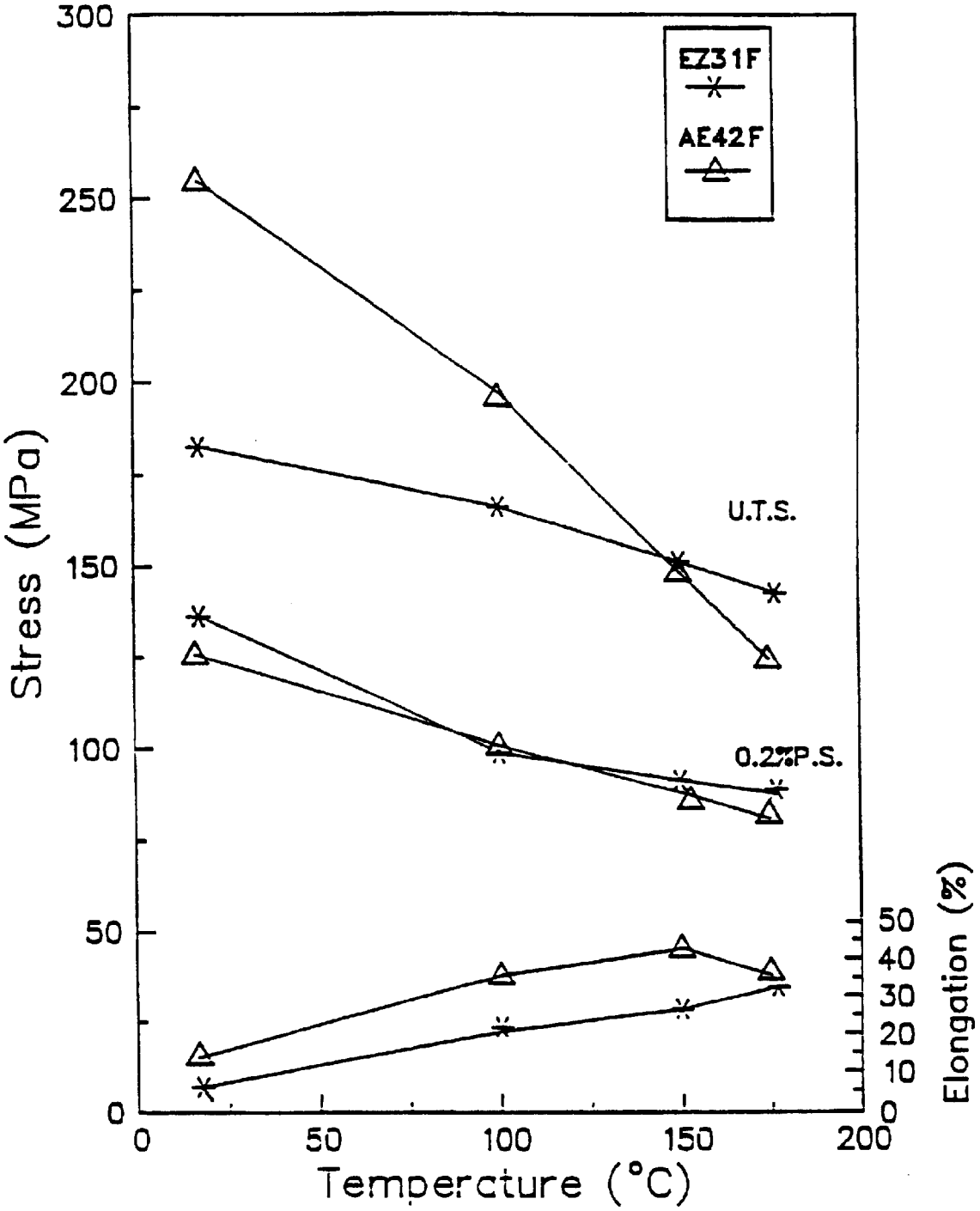
FIG. 6 illustrates and compares the tensile properties of pore free HPDC alloys MEZ and AE42.
Figure 7:
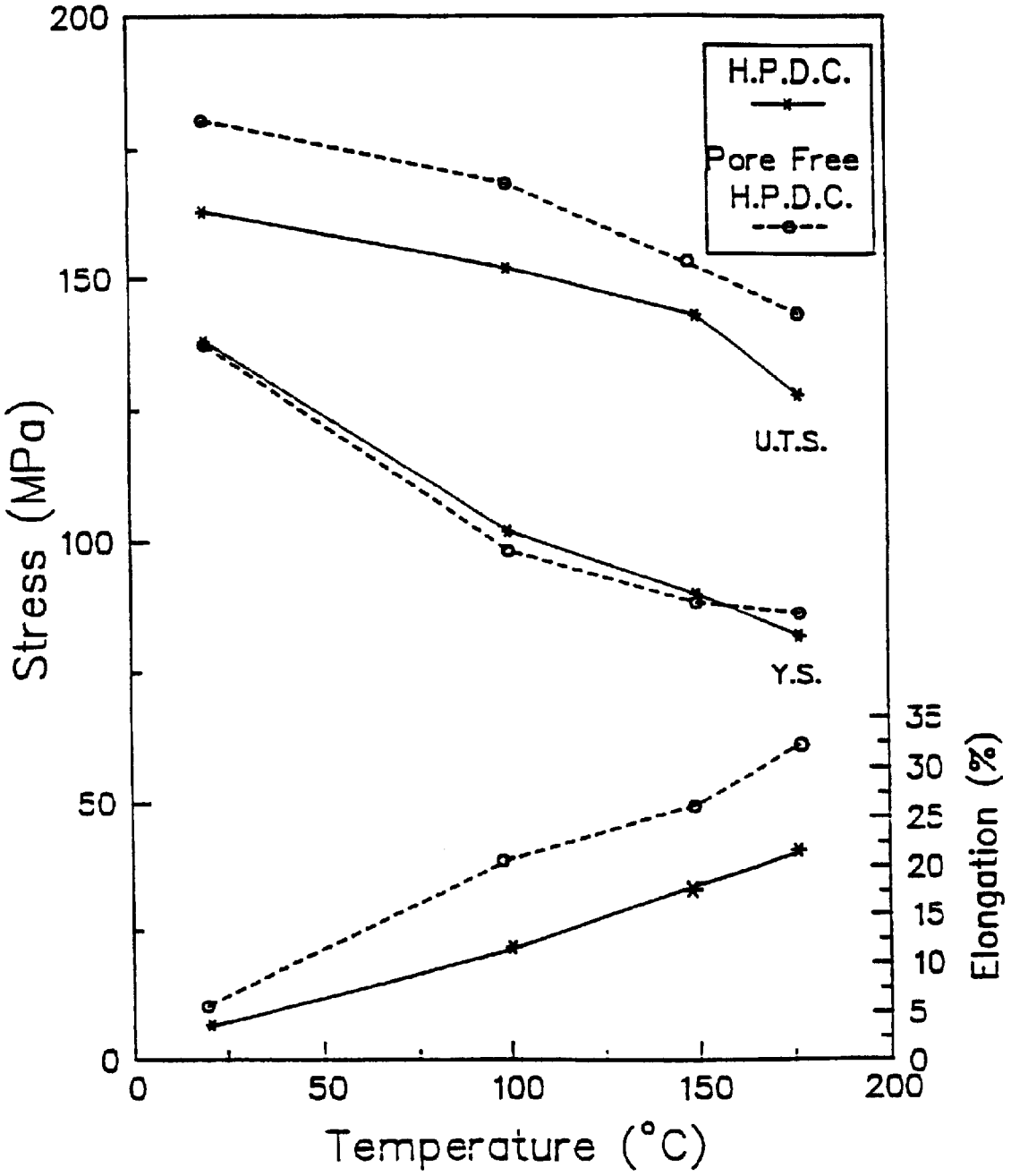
FIG. 7 illustrates and compares the tensile properties of HPDC MEZ and pore free HPDC (PFHPDC) alloys MEZ.
Figure 8:
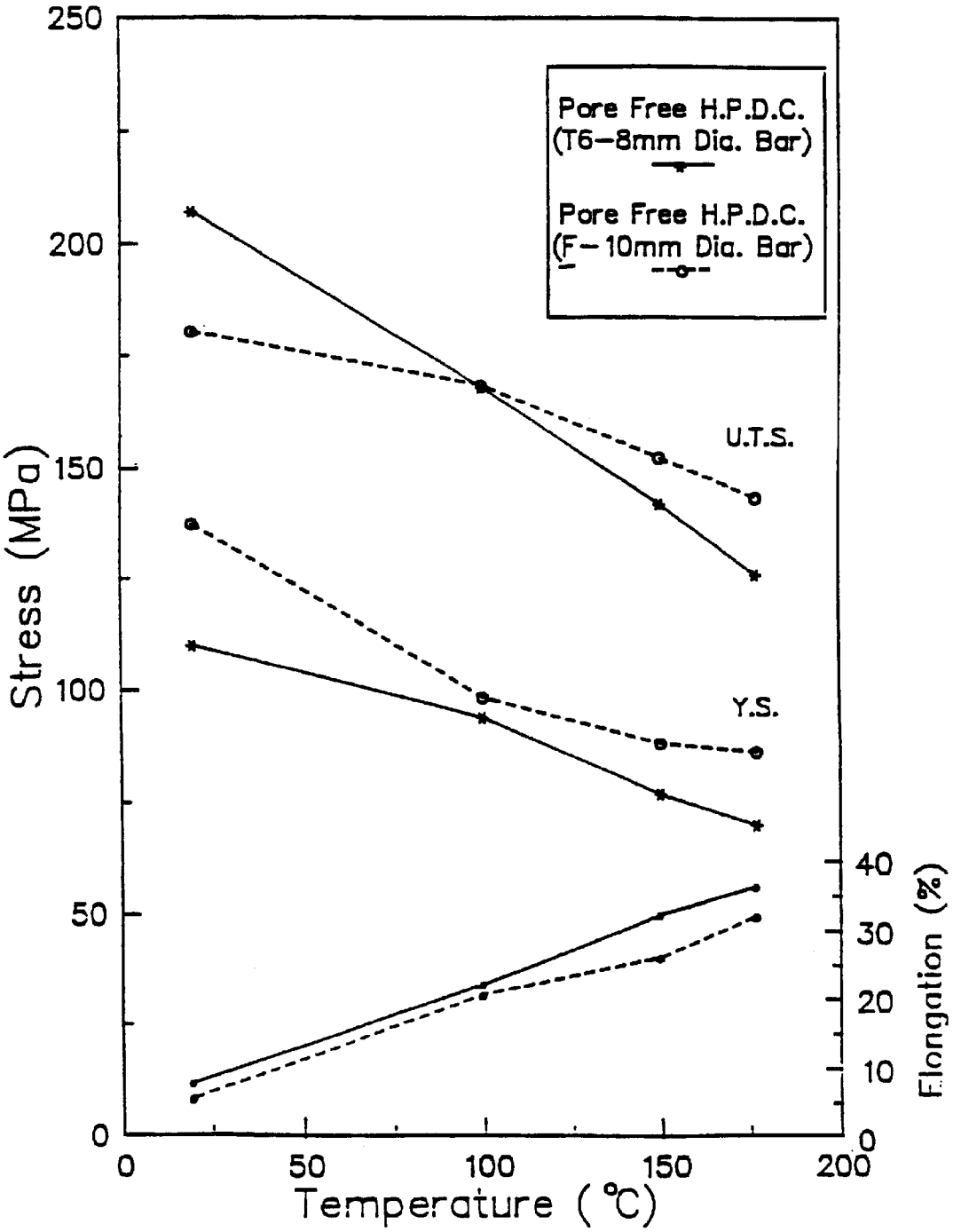
FIG. 8 illustrates the effect of heat treatment on the tensile properties of PFHPDC MEZ at various temperatures.

Table 7 and FIGS. 6 to 8 indicate the measured tensile properties of the test bars, together with comparative measurements on similar bars of AE42 alloy. It will be seen that MEZ and AE42 have similar yield strengths, but that while AE42 has a superior tensile strength at room temperature, the situation is reversed at higher temperatures. There appeared to be no useful advantage from the use of the pore free process, either in the bars as cast or after T6 heat treatment.

Table 8 shows the results of corrosion tests on the test bars, and similar bars of AE42. It proved difficult to remove all surface contamination, and the use of alternative treatments should be noted. Where the cast surface is removed, as in the standard preparation (B), the corrosion rates of MEZ and AE42 appeared similar.

Figure 9:
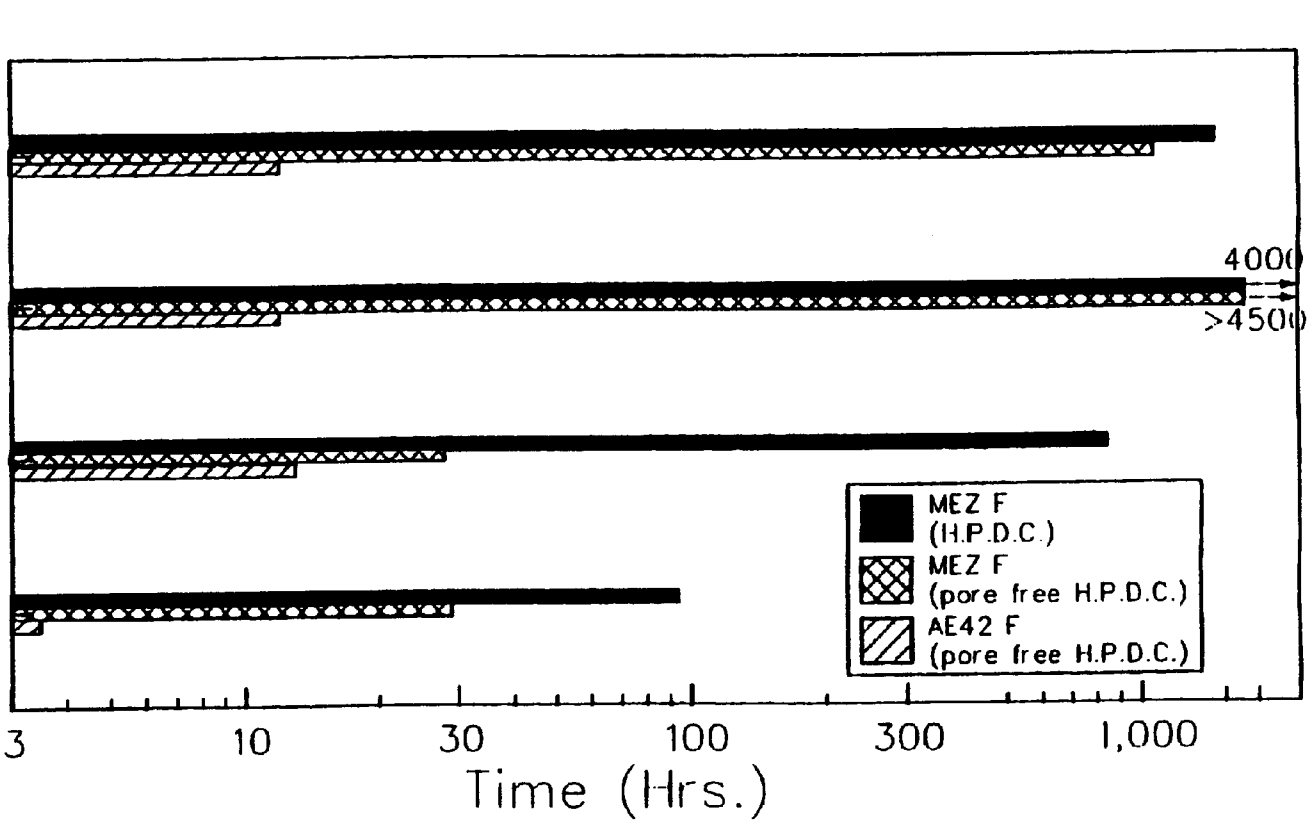
FIG. 9 shows the results of measuring creep resistance of PFHPDC MEZ, AE42 and ZC71 under various conditions of stress and temperature.

The results of creep measurement on bars of both alloys are shown in Table 9 and in FIG. 9. Despite the scatter of results, it can be seen that the creep strength of MEZ is far superior to that of AE42.

Figure 10:
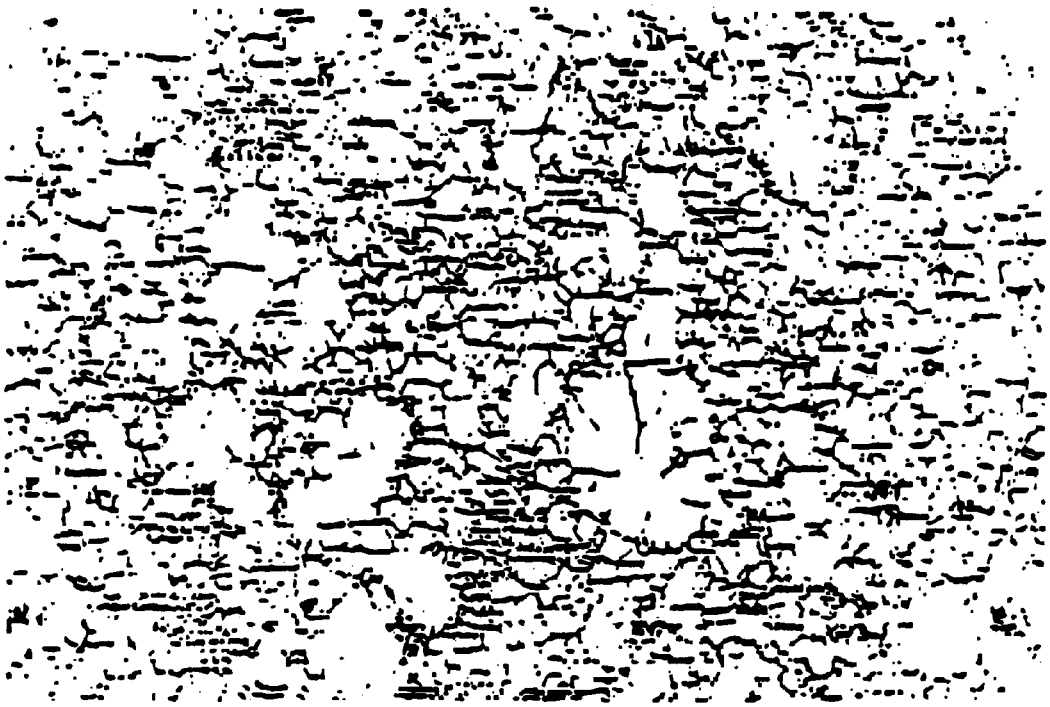
FIG. 10 shows the grain structure of PFHPDC MEZ in the as cast (F) condition.
Figure 11:
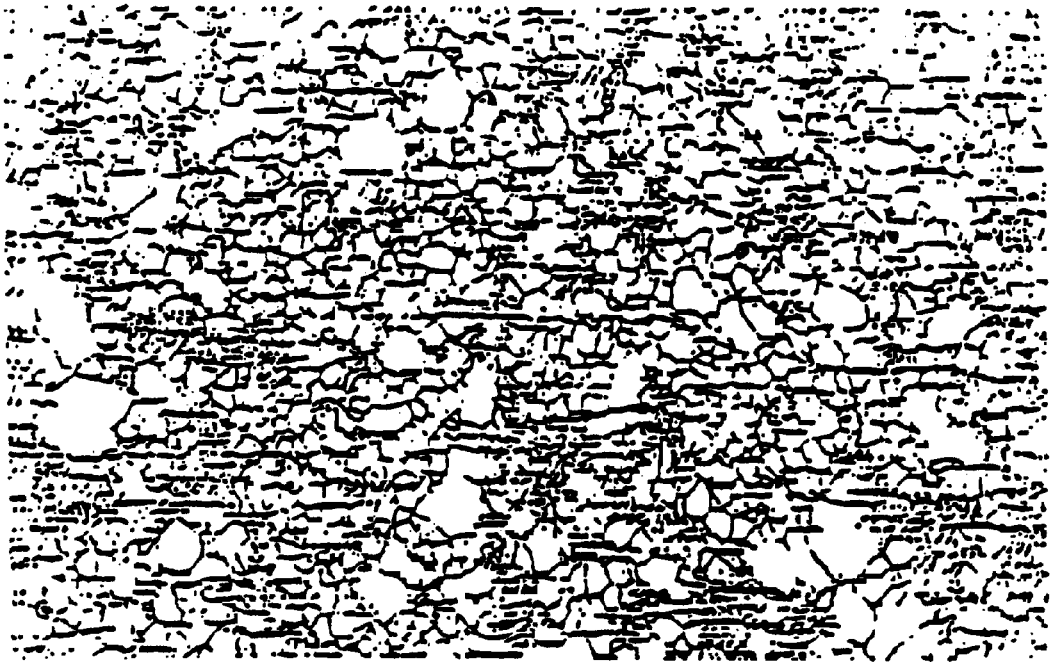
FIG. 11 shows the grain structure of PFHPDC MEZ in the T6 heat treated condition.
Figure 12:
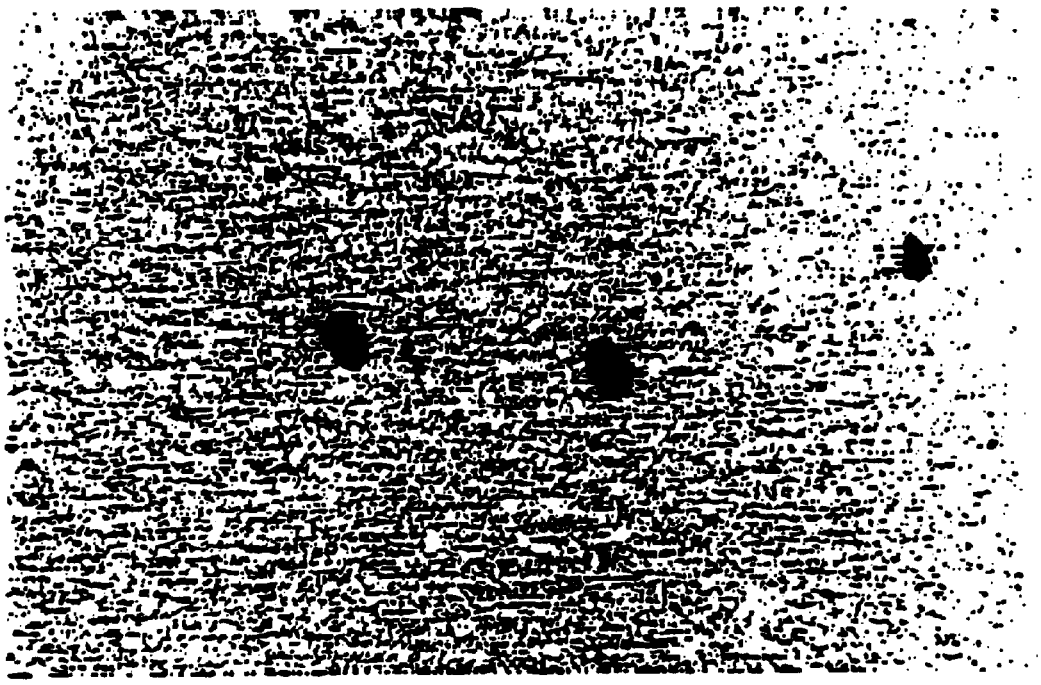
FIG. 12 shows the porosity of MPDC MEZ.

FIGS. 10 and 11 show the grain structure in a PFHPDC MEZ bars before and after T6 treatment, and FIG. 12 shows the porosity of an HPDC bar of MEZ.

As illustrated below, an advantage of the present invention is that prototypes for an HPDC mass production run can be gravity cast, and, in particular, can be gravity sand cast, in the same alloy and in the same configuration as required for the HPDC run, while obtaining similar tensile properties.

A melt comprising 0.35 weight percent zinc, 2.3 weight percent rare earth, 0.23 weight percent manganese and 0.02 weight percent zirconium (balance magnesium) was manufactured on a 2-tonne scale. A 150 Kg lot of the same ingot batch was remelted and cast in the form of an automotive oil pan configuration both by gravity sand casting and by HPDC. Specimens were cut from three castings in each case, and their tensile properties measured at ambient temperature, the results being shown in Tables 10 and 11 respectively it will be seen that there is a close resemblance between the tensile properties if the sandcast and diecast products.

In a separate test, a further ingot from the same batch was melted, but 6 weight percent of Zirmax (33% Zr) was added using conventional magnesium foundry practice. The analysis of the resulting melt gave 0.58 weight percent zirconium.

A section from a sandcasting made from this melt, of the same automotive oilpan configuration as above, was tensile tested at ambient temperature. 0.2% PS was 102 MPa, UTS was 178 MPa, and elongation was 7.3%, figures which are very similar to those of Tables 10 and 11.

These results may be contrasted with those for the alloy AE42 (Mg-4%Al-2%RE—Mn), not within the present invention, which may be used for applications requiring good creep resistance at elevated temperatures. In this case, although satisfactory properties can be generated in HPDC components, as illustrated elsewhere in this specification it is impossible to generate satisfactory properties in the alloy by conventional sand casting techniques.

For example, an alloy AE42 (3.68% Al; 2.0% RE; 0.26 Mn) was cast into steel chilled "arrow bar" moulds. Tensile properties of specimens machined from these bars were only 46 MPa (0.2% PS) and 128 MPa (UTS). Similar bars cast in an MEZ alloy gave values as high as 82 MPa (0.2% PS) and 180 MPa (UTS) (0.5% Zn; 2.4% RE; 0.2% Mn).

APPENDIX A

| TIME | OBSERVATION |
|---|---|
| | a) MEZ PFHPDC TRIAL |
| 0500 | Furnace 1 on, crucible fully charged with half ingot (109 kgs). |
| 1100 | Charge fully molten 650° C. |
| 1315 | Melt controlling at 684° C. — surface somewhat drossy. |
| 0500 | Furnace 2 on, remaining melt (approx 20 kg) from pre trial melted. |
| 1100 | Charge fully molten 650° C. |
| 1315 | Melt controlling at 690° C. — surface somewhat drossy. Both melts protected with Air + $SF_6$. Heavy oxide/sulphide skins evident on melt surfaces. |
| 1325 | Both halves of die mould preheated with gas torch (fixed half 41° C., moving half 40° C.). Die sleeve preheated with metal ladle poured from Furnace 2. |
| 1330 | Die mould further preheated by injection of metal ladle poured from Furnace 2. Three injections raised die temperature fixed half to 50° C. and moving half to 51° C. (FC1 analysis sample ladle poured). |
| 1335 | Oxygen switched on at 100 liters/min. Bar casting begins. Metal supply, ladle poured from No. 1 furnace for each shot (800 g). Die mould sprayed with graphite water based inhibited release agent throughout. |
| 1340 | Casting stopped after 3 shots metal chilling on ladle. Melt temperature raised to 700° C. |
| 1343 | Re-start casting at 683° C. casting rises to 700° C. Stop casting, adjust stroke of plunger. |
| 1350 | Re-start casting. No. 11 castings fractured (8 and 10 mm dia bars) both show good fracture. |
| 1400 | Casting stopped. (14 shots) plunger cleaned of oxide contamination. |
| 1410 | Restart casting melt temperature 701° C. Fixed half die temperature 71° C. Moving half die temperature 67° C. (FC 2 analysis sample ladle poured). |
| 1455 | Casting complete after 40 shots. 120 tensile bars + 40 charpy bars. (FC3 analysis sample ladle poured). |

NOTE: A further 10 PFHPDC shots were carried out following the HPDC trial giving a total of 150 tensile bars + 50 charpy bars.
Identification of each bar was carried out by marking each one respectively P-1, P-2, P-3, P-4, etc.

| | b) MEZ HPDC TRIAL |
|---|---|
| 1535 | Melt temperature in furnace 1 @ 699° C. Die mould preheated with first shot and bars discarded. Fixed half die mould temperature 74° C. Moving half die mould temperature 71° C. |
| 1536 | Bar casting begins, without oxygen, but with the same casting parameters as the PFHPDC trial, i.e. Pressure of 800 kgs/cm$^2$. 1.2 meters/sec plunger speed. 100–200 meters/sec at the ingate. Die locking force of 350 ton kg/cm$^2$. (FC1 analysis sample ladle poured). |
| 1550 | Bars 8 mm dia and 10 mm dia from shots 11 and 12 were fractured. Very slight shrinkage/entrapped air was observed. |
| 1600 | Fixed half die mould temperature increases to 94° C. Moving half die mould temperature increased to 89° C. (FC2 analysis sample ladle poured after shot 21, temp 702° C.) |
| 1610 | Casting stopped die mould cooled. Fixed half cooled to 83° C. Moving half cooled to 77° C. |
| 1620 | Re-start casting. |
| 1650 | Casting complete after 42 shots, 120 tensile bars + 42 charpy bars. (FC3 analysis sample ladle poured). |

NOTE: A further 10 HPDC shots were carried out following this trial giving a total of 152 tensile bars + 52 charpy bars.
Identification of each bar was carried out by marking each one respectively 0-1, 0-2, 0-3, etc.

APPENDIX A-continued

| TIME | OBSERVATION |
|---|---|
| | (c) AE42 HPDC Trial |
| 0200 | Furnace on, crucible previously fully charged with half ingots. |
| 1000 | Melt at 680° C. Die heating begins. |
| 1005 | Die temperature at 85° C. |
| 1015 | Sleeve heating using melt sample begins. Melt surface much cleaner than ZC71. Casting surfaces also less discoloured. |
| 1240 | Casting run begins. |
| 1430 | Casting run terminated. |

TABLE 3-continued

Creep Properties of Alloys based on MEZ and ZE53 Compositions at 177° C. (Arrow Bars)

| Melt No. | Condition | Time to Reach 0.1% CS (Hrs) | Initial plastic Strain (%) | Initial Elastic Strain (%) |
|---|---|---|---|---|
| DF2225 | T5 | 616 | | |
| | | 260 | | |

*Extrapolated, test terminated prematurely

TABLE 1

| Melt No. | Melt Size Kg | Alloy | Mn Addition % | Zirmax Addition % | RE % | Zn % | Mn % | Zr % | Fe % |
|---|---|---|---|---|---|---|---|---|---|
| DF2218 | 4.5 | ZE53, Zr | — | 6 | 3.1 | 4.9 | — | 0.67 | 0.003 |
| DF2219 | 4.5 | ZE53, Zr | — | 6 | 3.0 | 4.8 | — | 0.74 | 0.004 |
| DF2220 | 4.5 | MEZ, Zr | — | 6 | 2.9 | 0.5 | — | 0.52 | 0.003 |
| DF2221 | 4.5 | MEZ, Zr | — | 6 | 3.3 | 0.6 | — | 0.49 | 0.002 |
| DF2222 | 4.5 | ZE53, Mn | 0.3 | — | 3.4 | 5.0 | 0.28 | — | 0.046 |
| DF2223 | 4.5 | ZE53, Mn | 0.3 | — | 3.6 | 4.9 | 0.29 | — | 0.051 |
| DF2224 | 4.5 | MEZ, Mn | 0.3 | — | 3.3 | 0.5 | 0.28 | — | 0.039 |
| DF2225 | 4.5 | MEZ, Mn | 0.3 | — | 3.3 | 0.5 | 0.29 | — | 0.031 |

TABLE 2

| | | Tensile Properties, RT | | | Tensile Properties, 177° C. | | |
|---|---|---|---|---|---|---|---|
| Melt No | Condition | YS | TS | % El | YS | TS | % El |
| DF2218 | F | 116 | 176 | 4.3 | 83 | 149 | 19 |
| DF2219 | T5 | 154 | 203 | 3.3 | 111 | 154 | 17 |
| DF2220 | F | 102 | 173 | 7.5 | 65 | 142 | 24 |
| DF2221 | T5 | 107 | 177 | 7.8 | 66 | 129 | 32 |
| DF2222 | F | 77 | 134 | 2.5 | 63 | 126 | 19 |
| DF2223 | T5 | 87 | 139 | 2.1 | 73 | 120 | 24 |
| DF2224 | F | 75 | 141 | 3.8 | 55 | 125 | 13 |
| DF2225 | T5 | 73 | 141 | 2.8 | 56 | 112 | 15 |

Yield Strength (YS) and Tensile Strength (TS) in MPa
% El - Percentage Elongation
RT - Room Temperature

TABLE 3

Creep Properties of Alloys based on MEZ and ZE53 Compositions at 177° C. (Arrow Bars)

| Melt No. | Condition | Time to Reach 0.1% CS (Hrs) | Initial plastic Strain (%) | Initial Elastic Strain (%) |
|---|---|---|---|---|
| DF2218 | F | 345 | 0.008 | 0.16 |
| | | 240 | | |
| DF2219 | T5 | 1128 | | |
| | | 688 | | |
| DF2220 | F | 1050* | 0.001 | 0.13 |
| | | 744 | | |
| DF2221 | T5 | 124 | | |
| | | 262 | | |
| DF2222 | F | 3.5 | 0.11 | 0.18 |
| | | 3 | | |
| DF2223 | T5 | 2.0 | 0.03 | 0.15 |
| | | 4.5 | | |
| DF2224 | F | 4500* | 0.10 | 0.15 |
| | | 1030 | | |

Applied stress in all tests, 46 MPa (This is the value, according to Dow data, required to produce a 0.1% creep strain in 100 hours in HPDC AE42 material.) Values in table are individual results.

TABLE 4

| Melt No. | Condition | Corrosion Rate (mpy) | Fe Content (%) |
|---|---|---|---|
| DF2218 | F | 310 | 0.004 |
| DF2219 | T5 | 1000 | 0.004 |
| DF2220 | F | 18.4 | 0.003 |
| DF2221 | T5 | 23.2 | 0.003 |
| DF2222 | F | 450 | 0.049 |
| DF2223 | T5 | 1150 | 0.049 |
| DF2224 | F | 480 | 0.035 |
| DF2225 | T5 | 490 | 0.035 |

mpy - mils/year

TABLE 5

| | Analysis | | | Corrosion Rate (mpy) Bar Nos (Cast) | | | | Bar Nos (T5) | | | |
|---|---|---|---|---|---|---|---|---|---|---|---|
| Melt | Mn | Fe | Zr | 1 | 3 | 5 | 7 | 2 | 4 | 6 | 8 |
| DF2290 | 0.21 | 0.006 | 0.05 | 43 | 29 | 59 | 83 | 40 | 42 | 78 | 130 |
| DF2291 | 0.14 | 0.002 | 0.13 | 21 | 17 | 73 | 170 | 20 | 23 | 62 | 960 |

Each alloy also included 2.5 wt % RE and 0.5 wt % Zn mpy—mils/year;

analysis sample taken before bars were poured

TABLE 6

Die Casting Trial Melt Analysis

| Casting technique | Sample | Analysis (wt %) Zn | RE | Fe | Mn | Zr | Al |
|---|---|---|---|---|---|---|---|
| PFHPDC | FC1 | 0.3 | 2.3 | 0.002 | 0.21 | 0.11 | — |
| | FC2 | 0.3 | 2.2 | 0.001 | 0.21 | 0.01 | — |
| | FC3 | 0.3 | 2.3 | 0.001 | 0.21 | 0.01 | — |
| HPDC | FC1 | 0.3 | 2.2 | 0.001 | 0.21 | 0.00 | — |
| | FC2 | 0.3 | 2.3 | 0.001 | 0.21 | 0.02 | — |
| | FC3 | 0.3 | 2.2 | 0.001 | 0.21 | 0.01 | — |
| AE42 castings | Start | | 2.2 | 0.002 | 0.18 | | 4.1 |
| | Middle | | 2.2 | 0.002 | 0.19 | | 4.0 |
| | End | | 2.3 | 0.002 | 0.22 | | 4.1 |
| AE42 melt (55 ppm Be) | | | 2.4 | 0.002 | 0.26 | | 4.0 |

TABLE 7

| Casting | Specimen Diameter (mm) | Temp. of Test (° C.) | Heat Treatment | 0.2% PS (MPa) | TS (MPa) | % E1 |
|---|---|---|---|---|---|---|
| MEZ HPDC | 8 | 20 | F | 131 | 198 | 6 |
| | | 100 | | 121 | 167 | 11 |
| | | 150 | | 107 | 151 | 21 |
| | | 177 | | 105 | 146 | 33 |
| | 10 | 20 | | 138 | 163 | 4 |
| | | 100 | | 102 | 152 | 12 |
| | | 150 | | 90 | 143 | 18 |
| | | 177 | | 82 | 128 | 22 |
| MEZ PFHPDC | 8 | 20 | T6 | 110 | 207 | 8 |
| | | 100 | | 94 | 168 | 22 |
| | | 150 | | 77 | 142 | 33 |
| | | 177 | | 70 | 126 | 37 |
| | 10 | 20 | F | 137 | 180 | 6 |
| | | 100 | | 98 | 168 | 21 |
| | | 150 | | 88 | 152 | 26 |
| | | 150 | | 88 | 152 | 26 |
| | | 177 | | 86 | 143 | 32 |
| MEZ HPDC | 6.4 | 20 | F | 138 | 175 | 4 |
| MEZ PFHPDC | 6.4 | 20 | F | 145 | 172 | 3 |
| | 6.4 | 20 | T6 | 133 | 179 | 4 |
| AE42 HPDC | 6.4 | 20 | F | 128 | 258 | 17 |
| | | 100 | | 103 | 199 | 39 |
| | | 150 | | 86 | 151 | 46 |
| | | 177 | | 83 | 127 | 40 |

TABLE 8

Corrosion Test Results of HPDC MEZ in Accordance With ASTM B117 10 Day Salt Fog Test

| Casting | Heat Treatment | Original Bar Diam. (mm) | Corrosion Rate (mpy) (A) | (B) |
|---|---|---|---|---|
| MEZ HPDC | F | 10 | 469 | 74 |
| | | 8 | 109 | 64 |
| MEZ PFHPDC | F | 10 | 368 | 49 |
| | | 8 | 195 | 21 |
| MEZ PFHPDC | T6 | 10 | 302 | 41 |
| | | 8 | 114 | — |
| AE42 PFHPDC | F | 10 | | 44* |

mpy - mils/year
(A) - Sample preparation involves grit blast with $Al_2O_3$, pickle in 10% $HNO_3$ aqueous solution.
(B) - Sample preparation involves machining away cast surface and polishing sample with abrasive pumice powder.

TABLE 9

Creep properties of HPDC MEZ v AE42

| Casting | Test Temp. (° C.) | Stress (MPa) | Time to 0.1% Creep Strain (hrs) 1 | 2 | 3 | 4 | 5 |
|---|---|---|---|---|---|---|---|
| MEZ PFHPDC | 20 | 120 | 22 | 72 | 5 | 24 | |
| | 100 | 100 | 24 | 0.8 | 2 | 104 | |
| | 150 | 60 | 2448 | >7000 | >4500 | | |
| | 177 | 46 | 888 | 1392 | 808 | | |
| MEZ HPDC | 20 | 120 | 192 | 36 | 72 | 80 | |
| | 100 | 100 | 568 | 1128 | | | |
| | 150 | 60 | 2592 | 4626 | 5000* | | |
| | 177 | 46 | 832 | 474 | 3248 | 2592 | 213S |
| AE42 PFHPDC | 20 | 120 | 2 | 5 | | | |
| | 100 | 100 | 0.3 | 0.3 | | | |
| | 150 | 60 | 12 | 13 | | | |
| | 177 | 46 | 11 | 13 | | | |

*Extrapolated result
All testing on specimens with "as cast" surfaces
All specimen dimensions are 8.0 mm diameter × 32 mm

TABLE 10

Sandcast

| Specimen Identity | Tensile Properties 0.2% PS (MPa) | UTS (MPa) | E % |
|---|---|---|---|
| S1-1 | 101 | 131 | 4 |
| S1-2 | 102 | 147 | 4 |
| S2-1 | 115 | 145 | 4 |
| S2-2 | 132 | 147 | 4 |
| S3-1 | 115 | 131 | 8 |
| S3-2 | 107 | 147 | 4 |
| Mean | 112 | 141 | 4 |

TABLE 11

(Diecast)

| Specimen Identity | Tensile Properties 0.2% PS (MPa) | UTS (MPa) | E % |
|---|---|---|---|
| D1-1 | 122 | 151 | 4 |
| D1-3 | 120 | 1812 | 10 |
| D2-1 | 126 | 199 | 4 |
| D2-2 | 104 | 189 | 6 |
| D2-3 | 111 | 167 | 4 |
| D3-1 | 122 | 168 | 4 |
| D3-2 | 99 | 173 | 6 |
| Mean | 115 | 175 | 5.5 |

What is claimed is:

1. A magnesium base alloy suitable for high pressure die casting consisting of:

at least 91.9 weight percent magnesium;

0.1 to 2 weight percent of zinc;

2.1 to 5 weight percent of a rare earth metal component other than yttrium, the ratio of said zinc to said rare earth component being less than 1;

less than 0.5 weight percent calcium;

0 to 0.1 weight percent of an oxidation inhibiting element other than calcium;

no more man 0.001 weight percent strontium;

no more than 0.05 weight percent silver;

less than 0.1 weight percent aluminum, at least two elements selected from the group consisting of zirconium, hafniumn, and titanium, the amount of combination greater than 0 and less than 0.4%;

incidental impurities of less than about 0.15 weight per cent; and any balance being magnesium.

2. A magnesium base alloy suitable for high pressure die casting consisting of:

at least 91 weight percent magnesium;

0.1 to 2 weight percent of zinc;

2.1 to 5 weight percent of a rare earth metal component other than yttrium, the ratio of said zinc to said rare earth component being less than 1;

less than 0.5 weight percent calcium;

0 to 0.1 weight percent of an oxidation inhibiting element other than calcium;

greater than 0 and less than 0.4 weight percent of a combination of at least two elements chosen from the group consisting of zirconium, hafnium and titanium;

0 to 0.5 weight percent manganese, provided that at least one of said calcium, oxidation inhibiting element, zirconium, hafniumn, titanium, and manganese is not zero weight percent;

no more than 0.001 weight percent strontium;

no more than 0.05 weight percent silver;

no more than 0.1 weight percent aluminum;

incidental impurities of less than 0.15 weight per cent; and any balance being magnesium.

3. A magnesium base alloy suitable for high pressure die casting consisting of:

at least 91.9 weight percent magnesium;

0.1 to 2 weight percent of zinc;

2.1 to 5 weight percent of a rare earth metal component other than yttrium, the ratio of said zinc to said rare earth component being less than 1;

less than 0.5 weight percent calcium;

0 to 0.1 weight percent of an oxidation inhibiting element other than calcium;

no more than 0.001 weight percent strontium;

no more than 0.05 weight percent silver;

less than 0.1 weight percent aluminum;

at least two elements selected from the group consisting of zirconium hafnium, and titanium, the amount of combination greater than 0 and less than 0.4%;

no more than 0.1 weight percent of each of nickel and copper;

incidental impurities of less than about 0.15 weight percent; and any balance being magnesium.

4. An alloy according to claim 1 or 2 which contains no more than 0.05 weight percent aluminum.

5. A corrosion resistant magnesium-based alloy consisting of:

at least 91.9 weight percent magnesium;

0.1 to 2 weight percent of zinc;

2.1 to 5 weight percent of an element having an atomic weight of 57–71 or a mixture of said elements having an atomic weight of 57–71, the ratio of said zinc to said rare earth component being less than 1;

greater than 0 and less than 0.4 weight percent of at least two components chosen from the group consisting of zirconium, hafnium, and titanium, at least one optional component chosen from the group consisting of less than 0.5 weight percent calcium, up to 0.1 weight percent of an oxidation inhibiting element other than calcium, and up to 0.5 weight percent manganese, said at least one optional component being chosen such that said alloy contains no more than 0.005 weight percent of incidental undissolved iron;

no more than 0.00 1 weight percent strontium;

no more than 0.05 weight percent silver, less than 0.05 weight percent aluminum;

incidental impurities of less than 0.15 weight per cent; and any balance being magnesium.

6. An alloy according to claim 2, or 5 wherein there is less than 0.33 weight percent of the elements selected from said group consisting of zirconium, hafnium and titanium.

7. A cast alloy having the composition according to claim 5 whereby the characteristic creep resistance of said cast alloy is such that the time to reach 0.1 percent creep strain under an applied stress of 46 MPa at 177° C. is greater than 500 hours.

8. An alloy according to claim 5 wherein said calcium, manganese, oxidation inhibiting element, and zirconium and/or hafnium and/or titanium are chosen such that the cast product of said alloy, after heating to 250° C. for 24 hours has a creep resistance such that the time to reach 0.1 percent creep strain under an applied stress of 46 MPa at 177° C. is greater than 100 hours.

9. An alloy according to claim 5 wherein said calcium, manganese, oxidation inhibiting element, and zirconium and/or hafnium and/or titaniumn are chosen such that the cast alloy product exhibits a corrosion rate of less than 2.5 mm/year as measured according to the ASTM B 117 Salt Fog Test.

10. An alloy according to claim 1, 2 or 5 which is substantially free of aluminum.

11. An alloy according to claim 1, 2 or 5 wherein the rate earth component is cerium, cerium mischmetal or cerium depleted mischmetal.

12. An alloy according to claim 1, 2 or 5 wherein said rare earth metal component comprises 2.1 to 3 weight percent of said alloy.

13. An alloy according to claim 1, 2 or 5 wherein said zinc comprises no more than 1 weight percent of said alloy.

14. An alloy according to claim 13 wherein said zinc comprises no more than 0.6 weight percent of said alloy.

15. An alloy according to claim 1, 2 or 5 comprising substantially no aluminum and/or substantially no strontium and/or substantially no silver.

16. A method of producing a cast product wherein high pressure die casting is used in conjunction with an alloy according to claim 1, 2 or 5.

17. A method according to claim 16 further comprising pore free high pressure die casting.

18. A cast product produced by the method according to claim 16.

19. A cast product produced by the method according to claims 17.

20. A magnesium base alloy consisting of:

at least 91.9 weight percent magnesium;

0.1 to 2 weight percent of zinc;

2.1 to 5 weight percent of a rare earth metal component other than yttrium, the ratio of said zinc to said rare earth component being less than 1;

less than 0.5 weight percent calcium;

0 to 0.1 weight percent of an oxidation inhibiting element other than calcium;

no more than 0.001 weight percent strontium;

no more than 0.05 weight percent silver;

less than 0.1 weight percent aluminum;

at least two elements selected from the group consisting of zirconium, hafnium, and titanium, the amount of combination greater than 0 and less than 0.4%;

incidental impurities of less than about 0.15 weight per cent with incidental undissolved iron being present in an amount less than 0.005 weight percent; and any balance being magnesium.

* * * * *